US007940943B2

(12) United States Patent
Noro et al.

(10) Patent No.: US 7,940,943 B2
(45) Date of Patent: May 10, 2011

(54) SPEAKER DRIVING APPARATUS

(75) Inventors: Masao Noro, Hamamatsu (JP); Akira Arai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1245 days.

(21) Appl. No.: 11/580,737

(22) Filed: Oct. 12, 2006

(65) Prior Publication Data

US 2007/0092091 A1 Apr. 26, 2007

(30) Foreign Application Priority Data

Oct. 20, 2005 (JP) ..... 2005-306201

(51) Int. Cl.
*H04R 3/00* (2006.01)
*H04R 5/02* (2006.01)

(52) U.S. Cl. ..... 381/117; 381/111; 381/304

(58) Field of Classification Search ..... 381/87, 381/89, 111, 117, 303, 304, 305, 307, 322, 381/345

See application file for complete search history.

(56) References Cited

U.S. PATENT DOCUMENTS

| | | | | |
|---|---|---|---|---|
| 4,889,208 | A | | 12/1989 | Sugihara |
| 6,069,962 | A | * | 5/2000 | Miller ..... 381/308 |

FOREIGN PATENT DOCUMENTS

| | | | |
|---|---|---|---|
| JP | 57-168389 | | 10/1982 |
| JP | 61-005700 | | 1/1986 |
| JP | 3-80400 | B2 | 12/1991 |
| JP | 04309096 | A * | 10/1992 |
| JP | 6-74000 | | 10/1994 |
| JP | 2000-261878 | | 9/2000 |
| JP | 2002-528018 | | 8/2002 |
| JP | 2002-320300 | | 10/2002 |
| WO | WO 0022876 | | 4/2000 |

OTHER PUBLICATIONS

Notification of Reason for Refusal for Japanese Patent Application No. 2005-306201, mailed Dec. 16, 2008 (4 pages).

Japanese Office Action, dated Sep. 9, 2008, referencing JP-2005-306201.

* cited by examiner

*Primary Examiner* — Brian Ensey

(74) *Attorney, Agent, or Firm* — Morrison & Foerster LLP

(57) ABSTRACT

A speaker driving apparatus includes a speaker enclosure whose inside is tightly closed, at least two speakers that are provided to the speaker enclosure so as to have a common rear space, and a signal supplying unit that supplies a stereo left channel signal to the speaker in a first group and supplies a stereo right channel signal to the speaker in a second group. The at least two speakers being divided into two groups as the first group and the second group.

11 Claims, 15 Drawing Sheets

SPEAKER DRIVING APPARATUS

BACKGROUND OF THE INVENTION

The present invention relates to the technology of a speaker driving apparatus.

In the two-channel stereo audio equipment in the related art, two speakers are positioned on the right and left sides at a distance to some extent and also a stereo left channel signal and a stereo right channel signal are supplied to a stereo speaker and a right speaker respectively. Then, when a listener takes a position in a front center area between two channels, such listener can recognize an echolocation of a sound image in the lateral direction.

Further, the so-called 5.1 channel surround audio system in which three channels on the front center, rear left, and rear right sides and the channel for a low-pitched sound, for example, are provided in addition to two channels in the related art is spreading. With this arrangement, the listener can recognize echolocations of the sound image on the right and left and backwards and forwards and can experience the acoustic effects with the ambience of the scene. This acoustic effect is called the surround effect.

However, in the above surround audio system, there existed such problems that a space having some size is needed because a total of six speakers must be arranged around the listener and also a cost is increased owing to an increase of the speakers.

Therefore, the technology to bring about the surround effect by two-channel stereo audio signals has been proposed. For example, in the technology disclosed in JP-B-3-80400, a predetermined amplitude gain and a predetermined amount of phase change are set to the stereo input signals on two right and left channels and also reverse characteristics of the amplitude gain and an amount of phase change are provided with a simple structure. According to this technology, a sound field having the surround effect can be reproduced faithfully to an original sound by using the two-channel stereo audio equipment. Also, the surround effect can be produced even when a distance between the right and left speakers is small.

However, even though the technology set forth in JP-B-3-80400 is applied, no change is caused in such a situation that an area in which the listener can recognize the sound field accompanied by the surround effect is still limited around the front center between the right and left speakers. As a result, when a distance between the right and left speakers is small, an area in which the listener can recognize a sound field to produce the surround effect is very narrow. Also, it is impossible for a plurality of listeners to enjoy the surround effect simultaneously.

SUMMARY OF THE INVENTION

The present invention has been made under above circumstances, and it is an object of the present invention to provide the technology to make it possible for a listener to recognize a sound field having a surround effect in all directions in a stereo audio equipment in which a distance between the right and left speakers is small.

In order to solve the above problems, a speaker driving apparatus of the present invention, comprising:

a speaker enclosure whose inside is tightly closed;

at least two speakers that are provided to the speaker enclosure so as to have a common rear space; and a signal supplying unit that supplies a stereo left channel signal to the speaker in a first group and supplies a stereo right channel signal to the speaker in a second group, the at least two speakers being divided into two groups as the first group and the second group.

Preferably, the signal supplying unit has a surround effect applying unit for applying a surround effect to stereo signals, and stereo right and left channel signals to which the surround effect is applied by the surround effect applying unit are supplied to the speaker in the first group and the speaker in the second group respectively.

Preferably, the signal supplying unit has a low-frequency component monaural signal shaping unit for shaping a low frequency component into a monaural signal by extracting a low frequency component from the stereo right and left channel signals and then adding the low frequency component equally to right and left channels.

Also, the speaker driving apparatus of the present invention further includes a diaphragm whose one end is fixed to one face of the speaker enclosure and whose elasticity allows to vibrate, an opening structure provided to one face to which the diaphragm is fixed in a position corresponding to a vibrating part of the diaphragm to expose an internal space of the speaker enclosure, and a sealing member provided between the diaphragm and the opening structure to close a space exposed by the opening structure in a state that a vibration of the diaphragm is allowed, and keep an airtightness of the speaker enclosure. The speaker is fitted to any one face of the speaker enclosure.

Preferably, the speaker in the first group and the speaker in the second group are arranged such that mutual sound radiating directions have a spread at a predetermined angle.

Preferably, the speaker in the first group and the speaker in the second group are arranged such that a rear face of the speaker in the first group is opposed to a rear face of the speaker in the second group in the speaker enclosure.

BRIEF DESCRIPTION OF THE DRAWINGS

The above objects and advantages of the present invention will become more apparent by describing in detail preferred exemplary embodiments thereof with reference to the accompanying drawings, wherein.

An embodiment of the present invention will be explained with reference to the drawings hereinafter.

Figure 1:
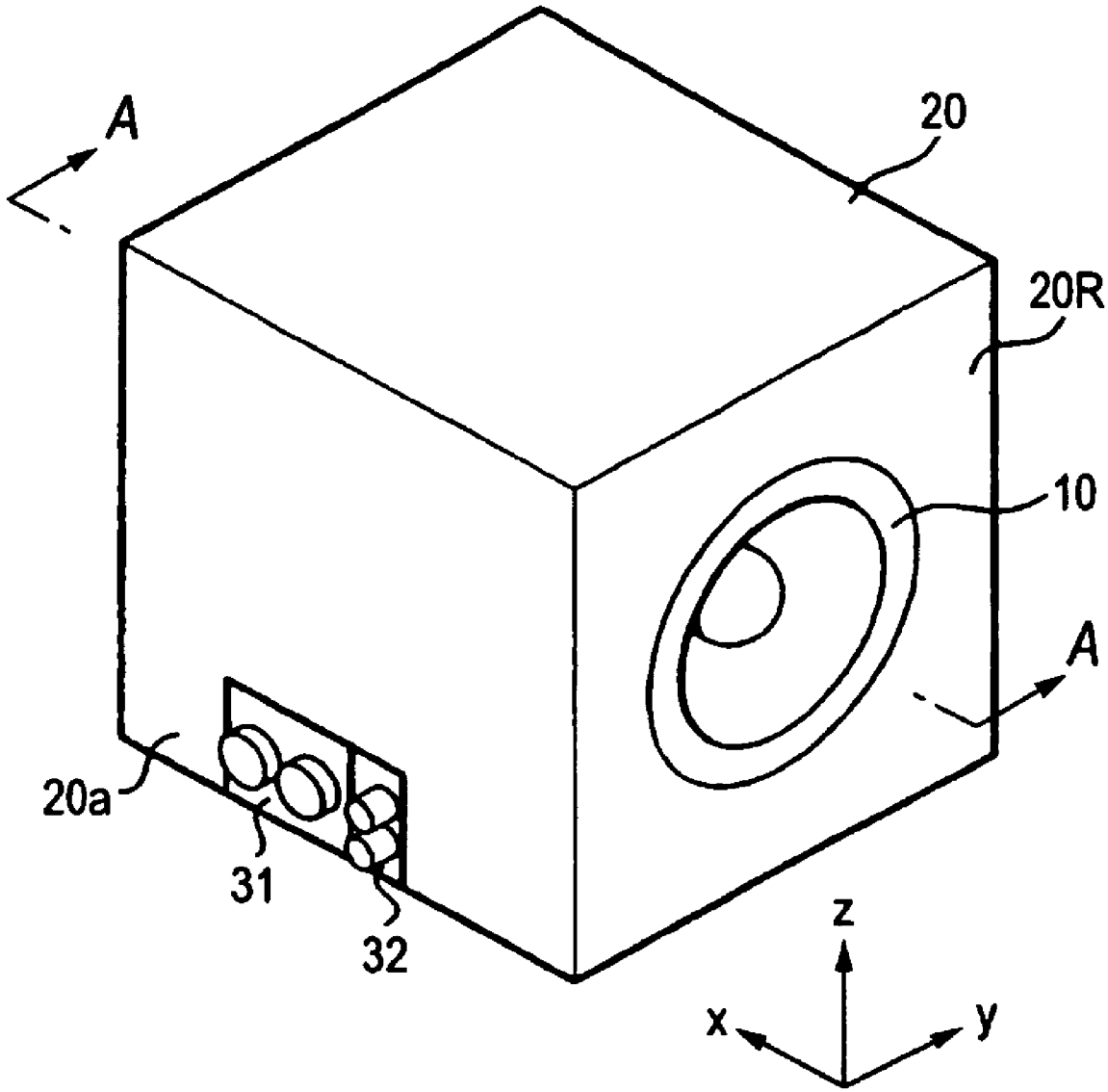
FIG. 1 is a perspective view showing an external appearance of a speaker system according to an embodiment of the present invention.
Figure 2:
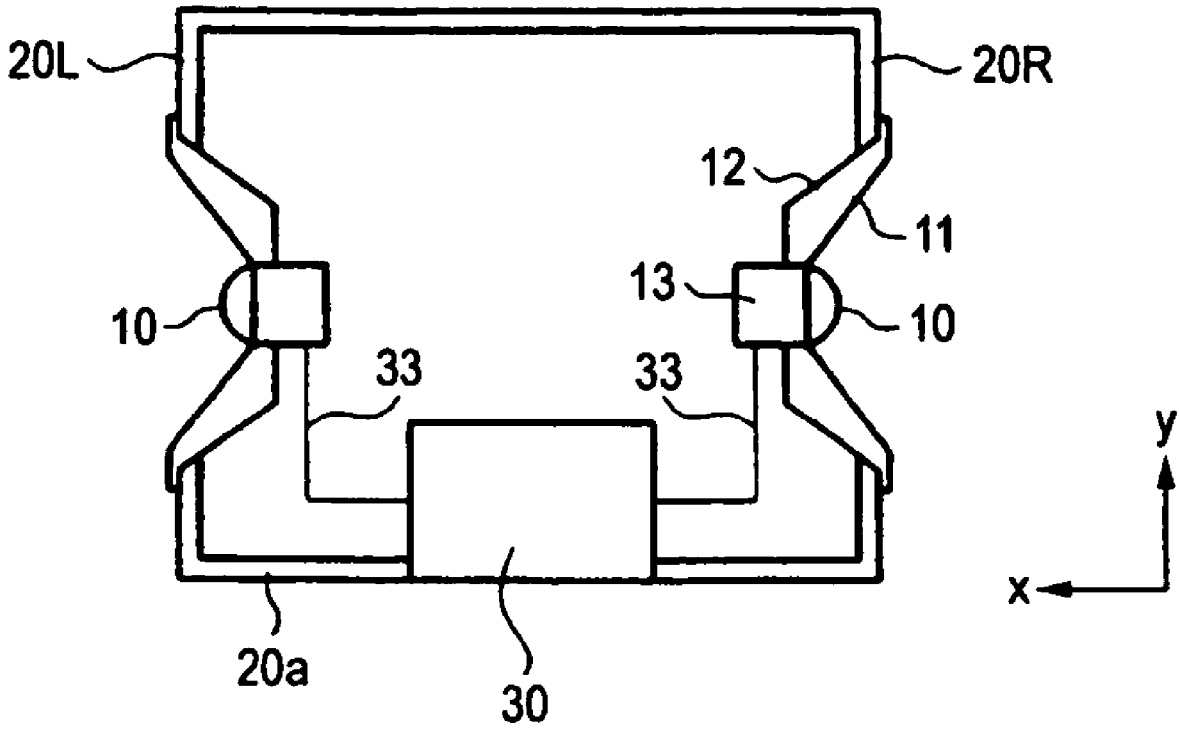
FIG. 2 is a sectional view of the speaker system taken along an A-A.

FIG. 1 is a perspective view showing an external appearance of a speaker system according to an embodiment of the present invention. FIG. 2 is a sectional view of the speaker system taken along an A-A in FIG. 1.

A speaker enclosure 20 is a closed box casing, and all six surfaces are formed of a plate member (e.g., wood, synthetic resin, metal, or their laminated synthetic member, or the like). In the following explanation, a face positioned in parallel with a zx plane of the speaker enclosure 20 in FIG. 1 is referred to as a front surface 20*a* and also faces positioned in parallel with a yz plane are referred to as side surfaces 20L, 20R.

A speaker fitting hole is provided to the side surfaces 20L, 20R of the speaker enclosure 20 respectively, and a speaker 10 is fitted to this speaker fitting hole. The speaker 10 is constructed roughly by a cone 11, a frame 12 for supporting the cone 11, a driving portion 13 consisting of a permanent magnet, a coil, etc. In the following explanation, a face to which the cone 11 is provided is referred to as a front face of the speaker 10 and face to which the driving portion 13 is provided is referred to as a rear face of the speaker 10. The speaker 10 is provided such that the rear faces to an internal space of the speaker enclosure 20. As apparent from FIG. 2, a rear space of two speakers 10 is a common space and two speakers 10 are arranged such that their rear faces oppose to each other.

In the speaker system of the present invention, a speaker driving apparatus 30 is provided in the inside of the speaker enclosure 20. An operation portion 31 having a power switch, a sound volume adjusting knob, etc., and input terminals 32 for inputting the audio signal are provided to the front surface 20*a* of the speaker enclosure 20. The right and left stereo audio signals output from the speaker driving apparatus 30 are supplied to the right and left speakers 10 via signal wires 33 respectively. In this case, a power for operating the speaker driving apparatus 30 may be supplied to the speaker driving apparatus 30 from an external power supply via electric wires, or may be supplied from a battery (not shown) inserted into the inside of the speaker enclosure 20.

Next, a circuit configuration of the speaker driving apparatus 30 will be explained hereunder. A circuit configuration of the speaker driving apparatus 30 can be embodied in various modes given in the following. In explanatory views of the speaker driving apparatus 30 (FIG. 3 to FIG. 11), for the sake of simplicity of illustration, a circuit diagram of the speaker driving apparatus 30 is depicted on the outside of the speaker enclosure 20.

CIRCUIT CONFIGURATION EXAMPLE 1

Figure 3:
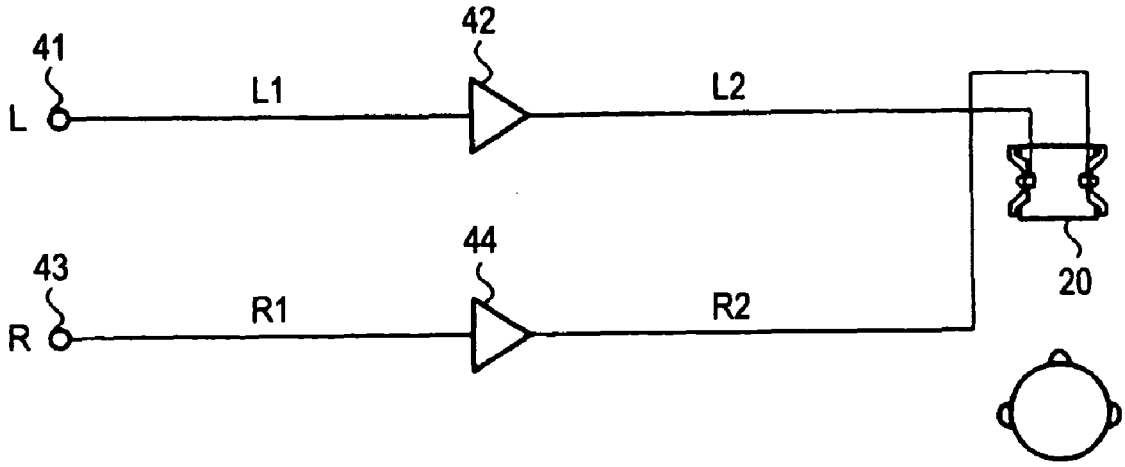
FIG. 3 is a view showing a circuit configuration example 1.

FIG. 3 is a view showing a circuit configuration example 1. In the speaker driving apparatus 30 in the present configuration example, a left stereo signal L1 input into an input terminal 41 is amplified by an amplifier 42 to generate a signal L2, and then supplied to the left speaker. Similarly, a right stereo signal R1 input into an input terminal 43 is amplified by an amplifier 44 to generate a signal R2, and then supplied to the right speaker.

According to this configuration, when the right and left speakers 10 are provided to one speaker enclosure 20, a separation between the right and left channels can be improved because acoustic waves on the right and left channels are radiated in separate directions.

CIRCUIT CONFIGURATION EXAMPLE 2

Figure 4:
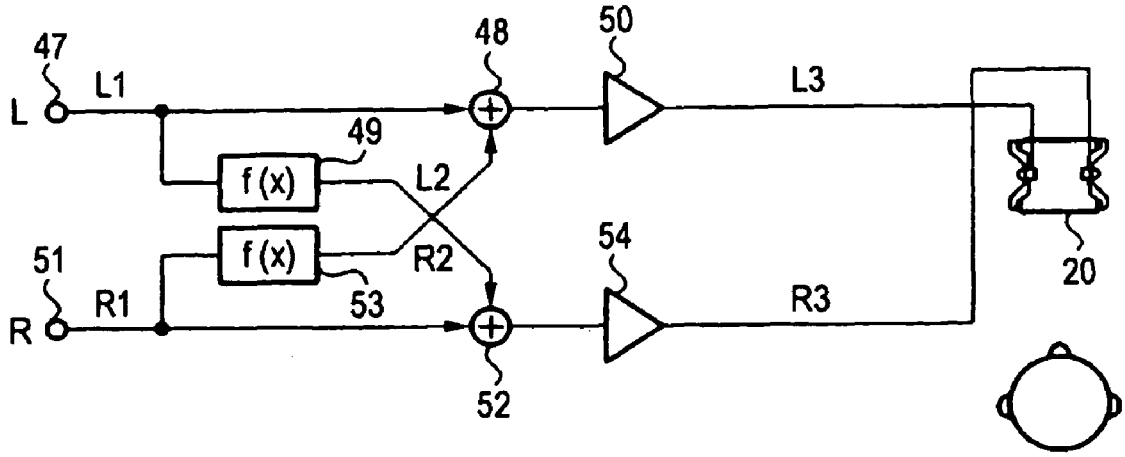
FIG. 4 is a view showing a circuit configuration example 2.

FIG. 4 is a view showing a circuit configuration example 2. In the speaker driving apparatus 30 in the present configuration example, a left stereo signal L1 input into an input terminal 47 is supplied to an adder 48 and a converter 49. The converter 49 generates a signal L2 by shifting a phase of the signal L1 based on a predetermined transfer function f(x) by a predetermined amount, and supplies it to an adder 52. Similarly, a right stereo signal R1 input into an input terminal 51 is supplied to an adder 52 and a converter 53. The converter 53 generates a signal R2 by shifting a phase of the signal R1 based on a predetermined transfer function f(x) by a predetermined amount, and supplies it to the adder 48.

The signal L1 and the signal R2 are added by the adder 48, a signal L1+R2 is amplified by an amplifier 50 to generate a signal L3, and this signal L3 is supplied to the left speaker. Similarly, the signal R1 and the signal L2 are added by the adder 52, a signal R1+L2 is amplified by an amplifier 54 to generate a signal R3, and this signal R3 is supplied to the right speaker.

According to this configuration, when the right and left speakers 10 are provided to one speaker enclosure 20, a separation between the right and left channels can be improved because acoustic waves on the right and left channels are radiated in separate directions. Also, since the signals in which a phase of the input right and left stereo signals is shifted by a predetermined amount are generated and then the input signal on one channel is cross-talked on the input signal on the other channel, a sound field that makes the listener feel an expanse can be formed and also the surround effect can be produced.

CIRCUIT CONFIGURATION EXAMPLE 3

Figure 5:
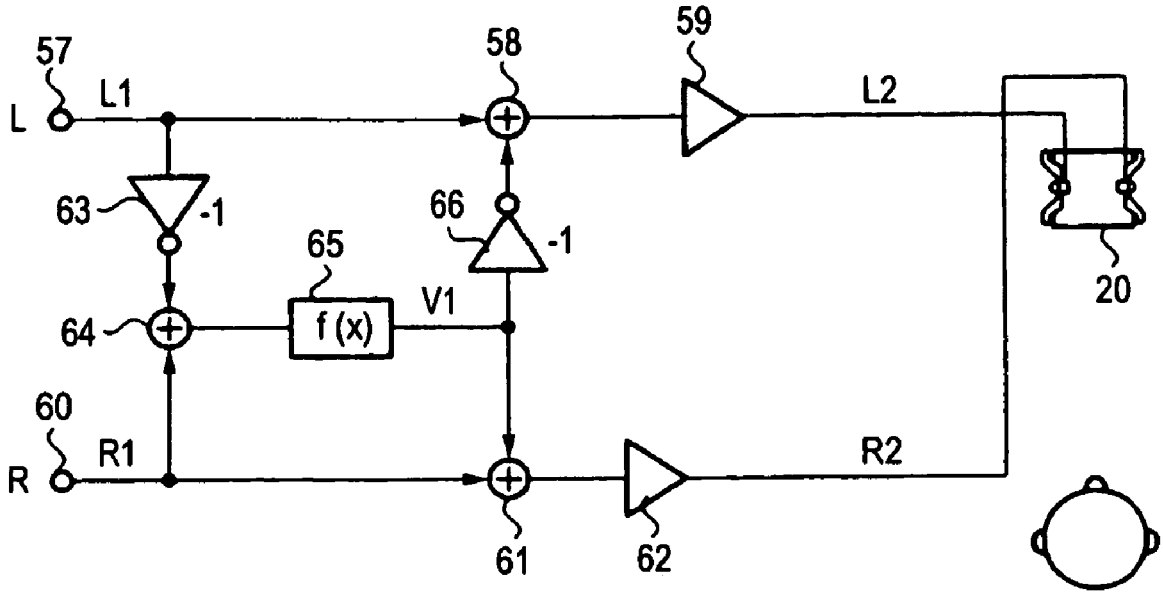
FIG. 5 is a view showing a circuit configuration example 3.

FIG. 5 is a view showing a circuit configuration example 3. In the speaker driving apparatus 30 in the present configuration example, a left stereo signal L1 input into an input terminal 57 is supplied to an adder 58 and an inverter 63. A signal −L1 that is opposite in phase to the signal L1 is generated by the inverter 63, and is supplied to an adder 64. The adder 64 adds the signal R1 input into the input terminal 60 and the signal −L1, and then supplies it to a converter 65. The converter 65 generates a signal V1 by shifting a phase of the signal −L1+R1 based on a predetermined transfer function f(x) by a predetermined amount, and supplies it to an inverter 66 and an adder 61. The inverter 66 generates a signal −V1 that is opposite in phase to the signal V1, and then supplies it to the adder 58.

The adder 58 adds the signal L1 and the signal −V1, and then a signal L1-V1 is amplified by an amplifier 59 to generate the signal L2 and this signal L2 is supplied to the left speaker. The adder 61 adds the signal R2 and the signal V1, and then a signal R2+V1 is amplified by an amplifier 62 to generate the signal R2 and this signal R2 is supplied to the right speaker.

According to this configuration, when the right and left speakers 10 are provided to one speaker enclosure 20, a separation between the right and left channels can be improved because acoustic waves on the right and left channels are radiated in separate directions. Also, like the circuit configuration example 3, since the signals in which a phase of the input right and left stereo signals is shifted by a predetermined amount are generated and then the input signal on one channel is cross-talked on the input signal on the other channel, a sound field that makes the listener feel an expanse can be formed and also the surround effect can be produced.

CIRCUIT CONFIGURATION EXAMPLE 4

Figure 6:
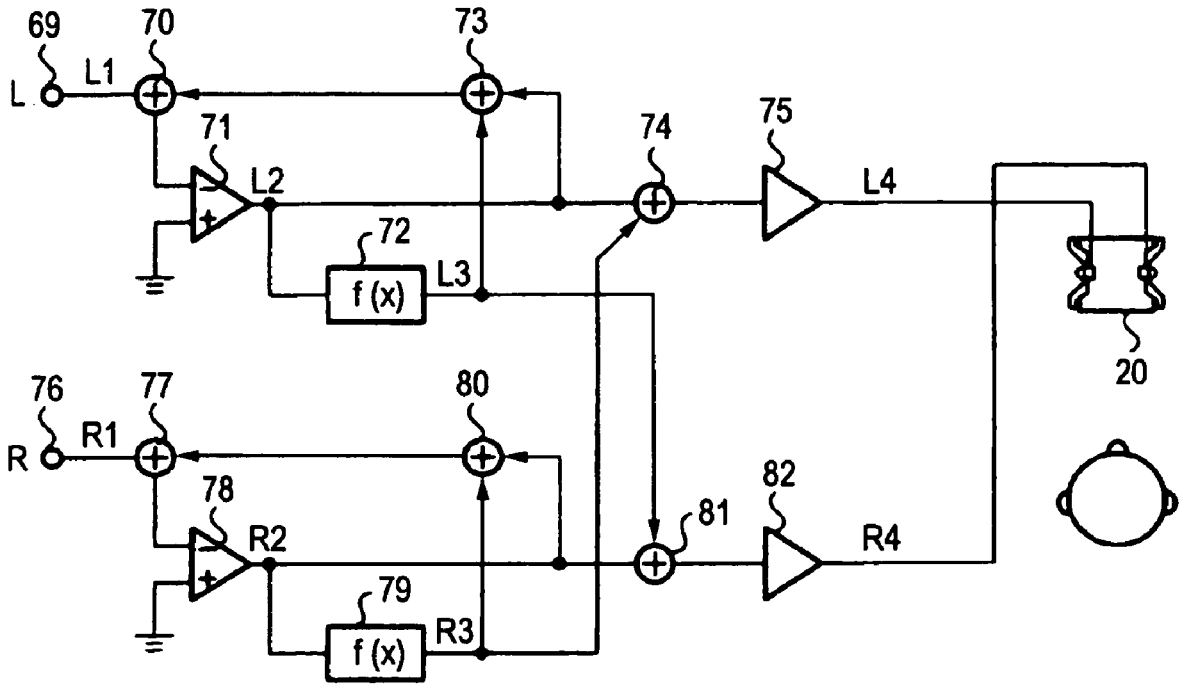
FIG. 6 is a view showing a circuit configuration example 4.

FIG. 6 is a view showing a circuit configuration example 4. In the speaker driving apparatus 30 in the present configuration example, a left stereo signal L1 input from an input terminal 69 is input into an inverted input terminal of an inverter 71 via an adder 70. A non-inverted input terminal of the inverter 71 is grounded. An output signal L2 of the inverter 71 is supplied to an adder 74 and a converter 72. The converter 72 generates a signal L3 by shifting a phase of the signal L2 based on a predetermined transfer function f(x) by a predetermined amount. The signal L2 and the signal L3 are added by an adder 73, then a signal L2+L3 and the input signal L1 are added by the adder 70, and then an added signal is input into an inverted input terminal of the inverter 71. Since the right channel has the similar configuration, its explanation will be omitted herein.

Then, the signal L2 and the signal R3 are added by the adder 74, and then a signal L4 is generated by amplifying an added signal by an amplifier 75 and supplied to the left speaker. Similarly, the signal L3 and the signal R2 are added by an adder 81, and then a signal R4 is generated by amplifying an added signal by an amplifier 82 and supplied to the right speaker.

According to this configuration, when the right and left speakers 10 are provided to one speaker enclosure 20, a separation between the right and left channels can be improved because acoustic waves on the right and left channels are radiated in separate directions. Also, like the circuit configuration examples 2, 3, since the signals in which a phase of the input right and left stereo signals is shifted by a predetermined amount are generated and then the input signal on one channel is cross-talked on the input signal on the other channel, a sound field that makes the listener feel an expanse can be formed and also the surround effect can be produced. In addition, in the present configuration example, a reverse characteristic of an amount of phase change can bee provided with a simple structure, and also a sound field producing the surround effect can be reproduced faithfully to an original sound. Here, the present configuration example is almost identical to the system disclosed in JP-B-3-80400.

CIRCUIT CONFIGURATION EXAMPLE 5

Figure 7:
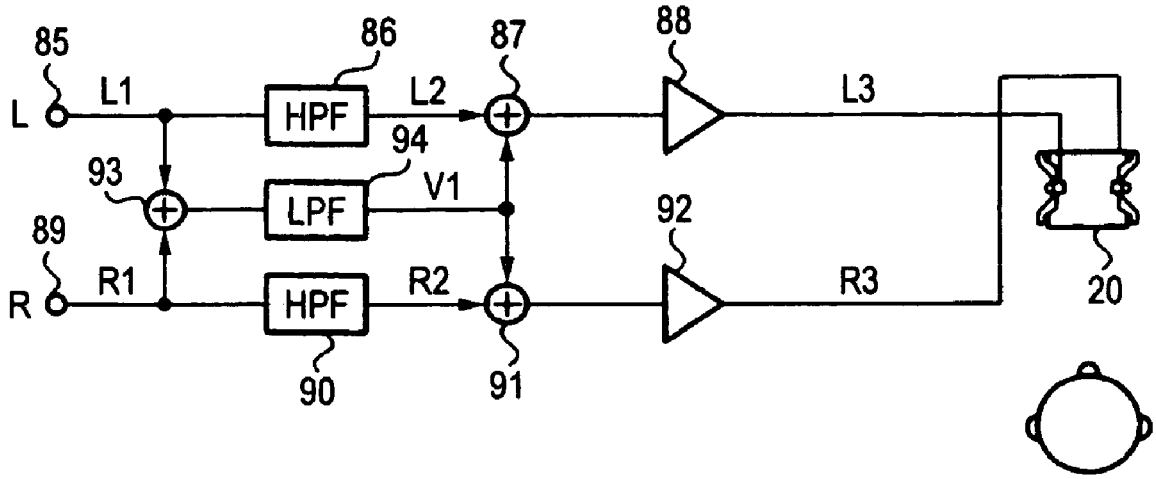
FIG. 7 is a view showing a circuit configuration example 5.

FIG. 7 is a view showing a circuit configuration example 5. In the speaker driving apparatus 30 in the present configuration example, a left stereo signal L1 input from an input terminal 85 is supplied to a HPF (high-pass filter) 86 and an adder 93. The HPF 86 outputs a high-frequency component signal L2 of the signal L1. Similarly, a right stereo signal R1 input from an input terminal 89 is supplied to a HPF (high-pass filter) 90 and the adder 93. The HPF 90 outputs a high-frequency component signal R2 of the signal R1.

The adder 93 adds the signal L1 and the signal R1, and supplies an added signal to an LPF (low-pass filter) 94. The LPF 94 outputs a low-frequency component signal V1 of the signal L1+R1, and supplies it to adders 87, 91. The adder 87 adds the signal L2 and the signal V1, and then a signal L2+V1 is amplified by an amplifier 88 to generate a signal L3 and this signal L3 is supplied to the left speaker. The adder 91 adds the signal R2 and the signal V1, and then a signal R2+V1 is amplified by an amplifier 92 to generate a signal R3 and this signal R3 is supplied to the right speaker.

According to this configuration, when the right and left speakers 10 are provided to one speaker enclosure 20, a separation between the right and left channels can be improved because the acoustic waves on the right and left channels are radiated in separate directions. Also, the low-pitched sound signal is formed as a monaural signal, then the monaural low-frequency signal is added to right and left high-frequency stereo signals respectively, and then respective right and left signals are output from the right and left speakers. The effects produced by this configuration are similar to the 3D stereo acoustic equipment in the related art, and the low-pitched sound can be emphasized with a simple configuration, so that the listener can enjoy the impressive music.

Figure 8:
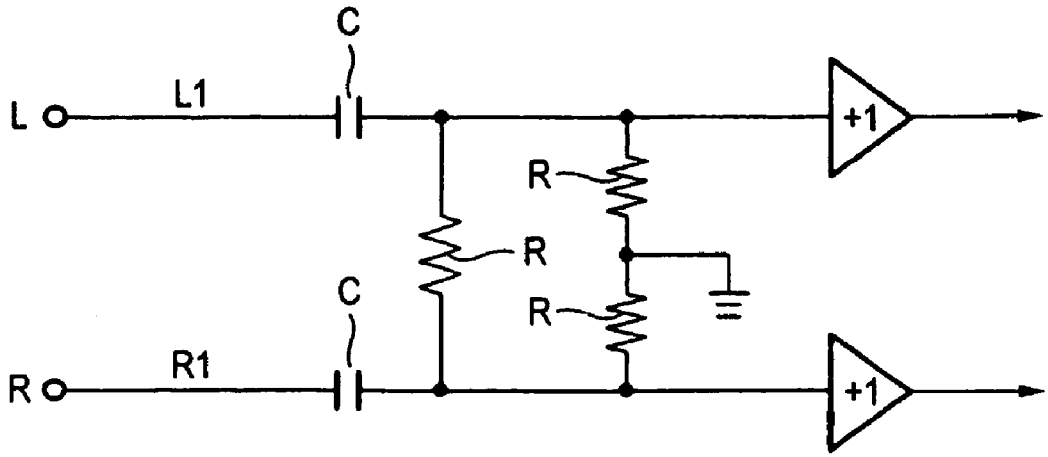
FIG. 8 is a view showing an embodiment of the circuit configuration example 6.
Figure 9:
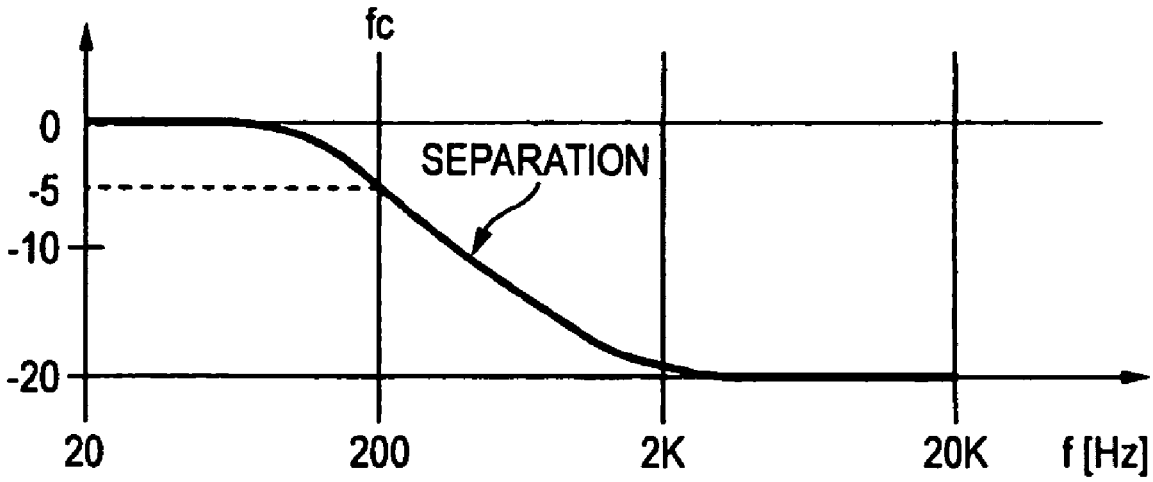
FIG. 9 is a chart showing the frequency characteristic of the circuit configuration example 6.

In this case, a circuit shown in FIG. 8 is an embodiment of the circuit configuration example 5 shown in FIG. 7, and can achieve the effect equivalent to the circuit configuration example 5. By using this circuit configuration, as shown in FIG. 9, the flat frequency characteristic can be realized and also the sound field that does not need a separation in the low frequency range, i.e., whose low frequency signal is given by the monaural signal can be formed.

CIRCUIT CONFIGURATION EXAMPLE 6

Figure 10:
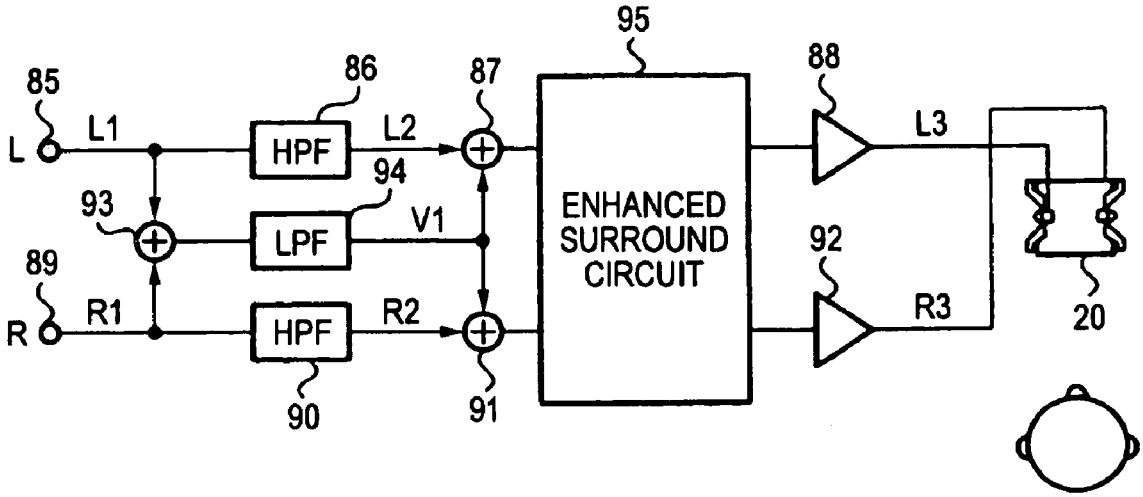
FIG. 10 is a view showing a circuit configuration example 6.

FIG. 10 is a view showing a circuit configuration example 6. In FIG. 10, reference symbols 85 to 94 show the same configurations as the circuit configuration example 5. In the speaker driving apparatus 30 in the present configuration example, signals output from adders 87, 91 are input into the publicly known enhanced surround circuit 95 to expand a sound field, and respective signals are supplied to the right and left speakers via the amplifiers 88, 92.

According to this configuration, when the right and left speakers 10 are provided to one speaker enclosure 20, a separation between the right and left channels can be improved because the acoustic waves on the right and left channels are radiated in separate directions. Also, the low-pitched sound signal is formed as a monaural signal, then the monaural low-frequency signal is added to right and left high-frequency stereo signals respectively, and then respective right and left signals are output from the right and left speakers. The effects produced by this configuration are similar to the 3D stereo acoustic equipment in the related art, and the low-pitched sound can be emphasized with a simple configuration, so that the listener can enjoy the powerful music. In addition, the sound field having a spreading feeling can be produced by the enhanced surround circuit 95, and also an enhanced surround effect can be produced.

CIRCUIT CONFIGURATION EXAMPLE 7

Figure 11:
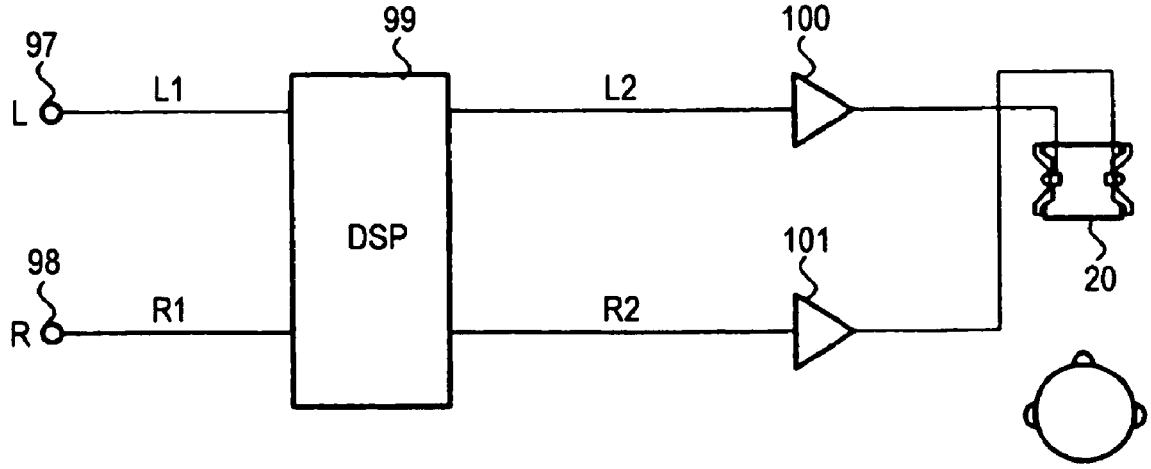
FIG. 11 is a view showing a circuit configuration example 7.

FIG. 11 is a view showing a circuit configuration example 7. In the speaker driving apparatus 30 in the present configuration example, the right and left stereo signals L1, R1 input from input terminals 97, 98 are input into a publicly known DSP (Digital Signal processor) 99 to output the signals L2, R2. Then, the signals L2, R2 are supplied to the right and left speakers via amplifiers 100, 101 respectively. The DSP 99 is constructed to produce the same effects as those of the circuit configuration examples 1 to 6, and produces the acoustic characteristics in various audio spaces.

According to this configuration, the same advantages as those of the circuit configuration examples 1 to 6 can be achieved, and also the sounds to which the acoustic characteristics in various audio spaces can be given can be obtained.

As explained above, according to the present invention, in the stereo audio equipment in which a distance between the right and left speakers is small, a separation between the right and left channels can be improved because acoustic waves on the right and left channels are radiated in separate directions. Therefore, the listener can enjoy the stereo sound in any direction even by the stereo audio equipment in which both right and left speakers are provided to one small enclosure. Also, if the speaker driving apparatus shown in above circuit configuration examples is employed, the listener can enjoy the stereo sound having the surround effect in any direction.

<Variation>

With the above, embodiments of the present invention are explained. But the present invention is not limited to the above embodiments, and the present invention can be embodied in various modes. Examples will be given hereunder.

Figure 12:
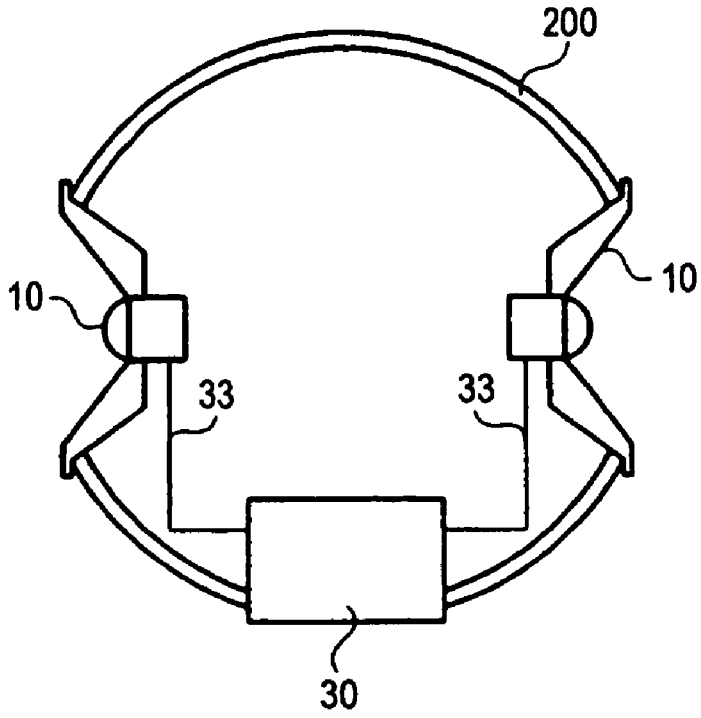
FIG. 12 is a view showing a speaker enclosure 200.

(1) FIG. 12 is a view showing an example using a speaker enclosure 200 whose sectional shape is a spherical form when viewed from the top. The rear space of two speakers 10 is a common space, and two speakers 10 are arrange such that their rear faces oppose to each other.

Figure 13:
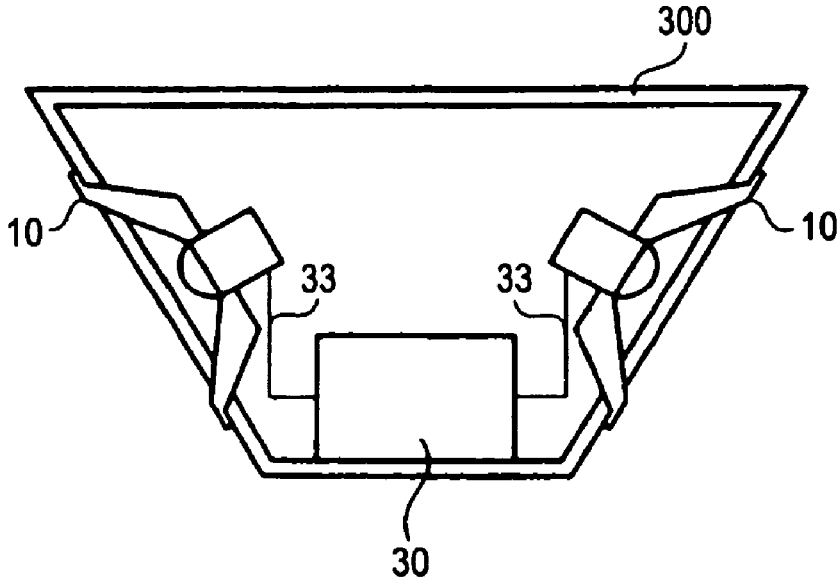
FIG. 13 is a view showing a speaker enclosure 300.

(2) FIG. 13 is a view showing an example using a speaker enclosure 300 whose sectional shape is a trapezoidal form when viewed from the top. In this example, the rear space of two speakers 10 is a common space, but the rear faces of two speakers are not parallel with each other and are provided at a predetermined angle. That is, the rear faces of two speakers 10 are provided at a predetermined angle such that a radiation direction of a sound wave from two speakers 10 is broadened. A predetermined angle is set arbitrarily. According to this configuration, the same advantages as those in the above embodiments can be achieved.

(3) In the above embodiments, an example of the speaker system where the rear space of two speakers are used commonly is illustrated. But the number of speakers is not restricted to two. In other words, any number of speakers may be employed if two speakers or more are divided into two groups and then the stereo left channel signal is supplied to the speakers in one group and the stereo right channel signal is supplied to the speakers in the other group. For example, the present invention can be embodied in any mode such as a mode in which four speakers are divided into two groups each consisting of two speakers, or the like.

Figure 14:
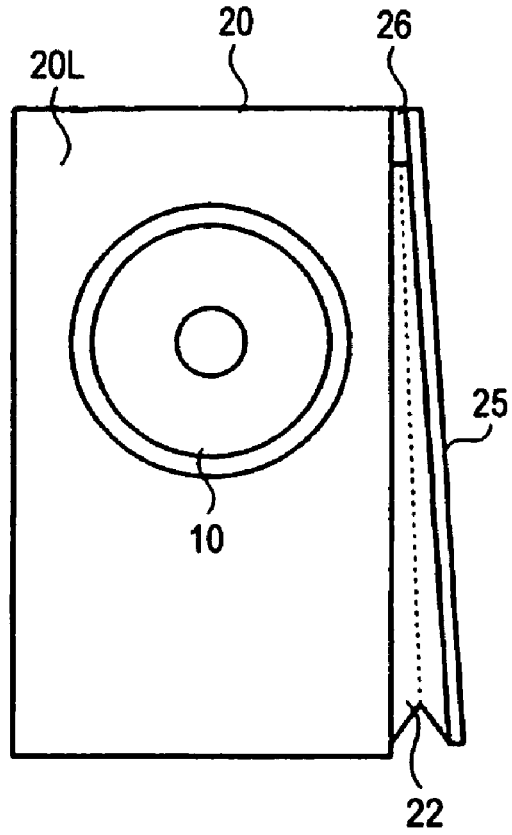
FIG. 14 is a view showing a side surface 20L of a speaker enclosure 20.
Figure 15:
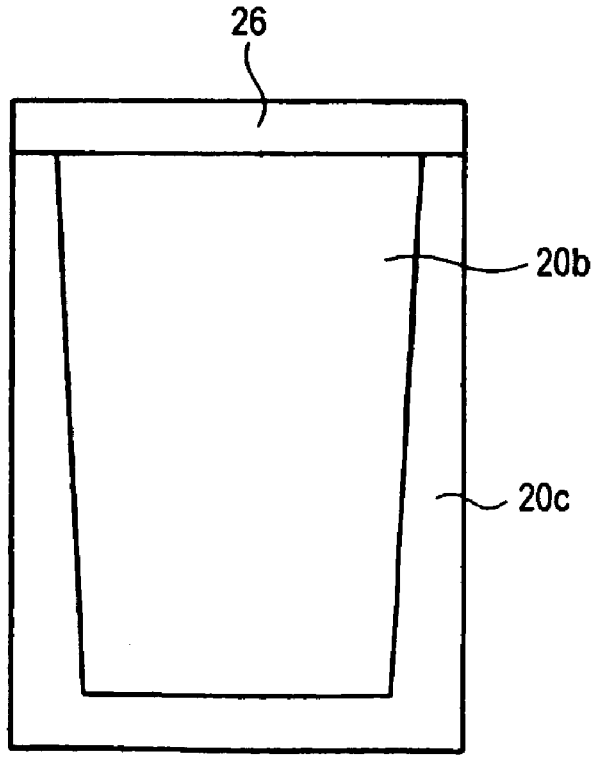
FIG. 15 is a view showing a front surface of the speaker enclosure 20.
Figure 16:
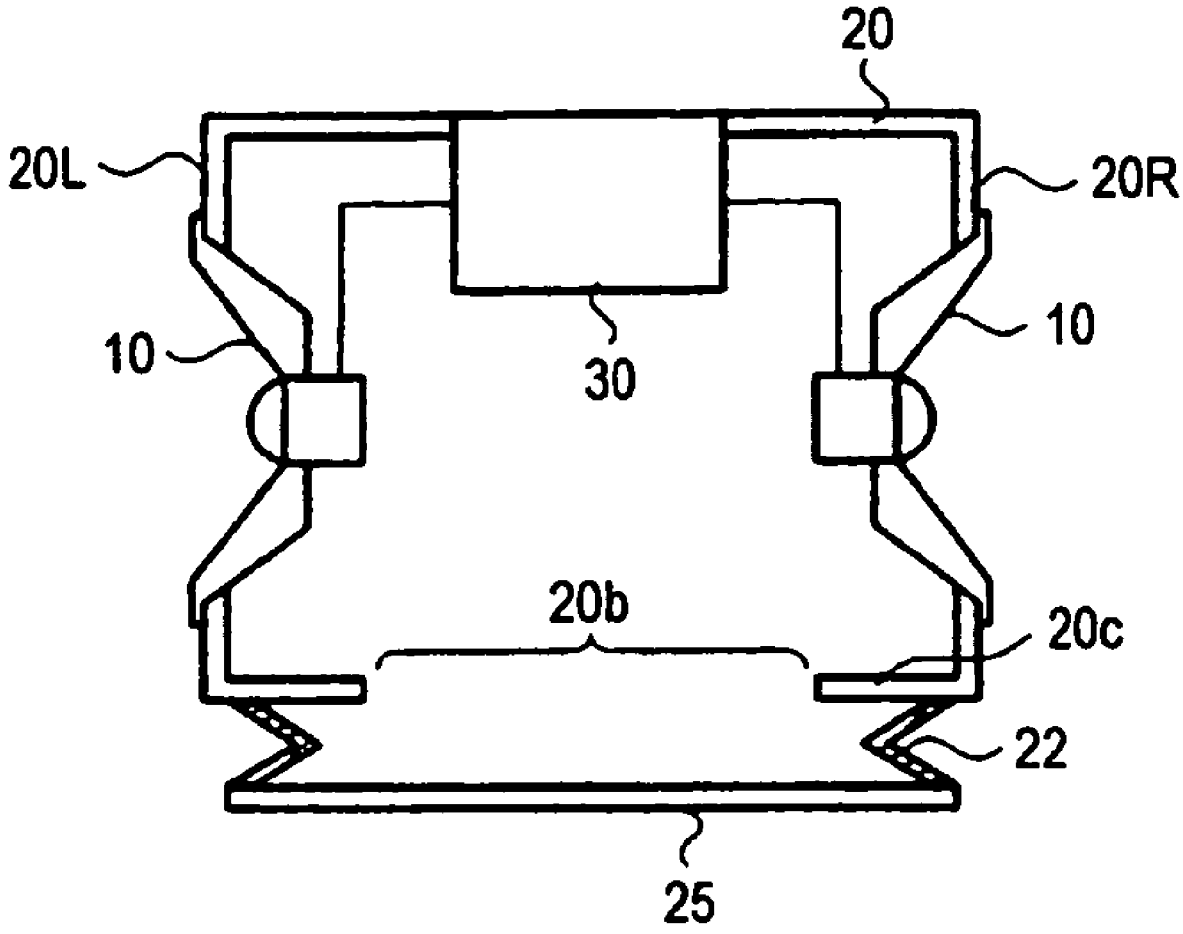
FIG. 16 is a sectional view of the speaker enclosure 20 when viewed from the top.

(4) Next, an example where a diaphragm is provided to a front surface of a speaker enclosure 20 will be explained hereunder. FIG. 14 is a view showing a side surface 20L of a speaker enclosure 20. FIG. 15 is a view showing a front surface of the speaker enclosure 20. FIG. 16 is a sectional view of the speaker enclosure 20 when viewed from the top.

Then, 20*b* is an opening portion that is provided to the front face of the speaker enclosure 20. A jointing member 26 is provided to an upper edge portion of the opening portion 20*b*, and a diaphragm 25 is fitted via the jointing member 26 to cover the opening portion 20*b*. A clearance is formed between an edge portion 20*c* of the opening portion 20*b* and the diaphragm 25. An edge (sealing member) 22 is provided to close this clearance, so that an airtightness of the speaker enclosure 20 can be maintained.

The diaphragm 25 is fixed by the jointing member 26, but the other end of the diaphragm 25 is constructed as a free end like a cantilever. Also, the edge 22 is projected between the edge portion 20*c* and an outer periphery of the diaphragm 25 toward the inner space side of the speaker enclosure 20 and is bent, so that the diaphragm 25 can vibrate freely by its own elasticity. The diaphragm 25 is formed of a thin wood plate, a thin synthetic resin, a metal plate, or their laminated synthetic member, for example.

In the above configuration, when the speakers 10 are driven, a vibration of cone papers of the speakers 10 is propagated to an air in the speaker enclosure 20 and then the diaphragm 25 is vibrated by the vibration of this air. At this time, the diaphragm 25 compresses or expands an air volume in the speaker enclosure 20 when such diaphragm vibrates in a state that the airtightness of the speaker enclosure 20 is kept by the edge 22. Therefore, a new resonance frequency is produced by a compliance (mechanical flexibility) caused by an air spring of the speaker enclosure 20 together with an elasticity of the diaphragm 25 and an equivalent mass of the diaphragm 25. As a result, a sound reproduced around the resonance frequency of the diaphragm 25 is produced.

Here, the air spring and the elasticity (spring force) of the diaphragm 25 function equivalently to two parallel-connected springs, but the air spring has a smaller compliance than a spring force of the diaphragm 25. Therefore, the resonance frequency of the diaphragm 25 as the speaker system is decided substantially by the compliance of air and the equivalent mass of the diaphragm 25.

Figure 17A:
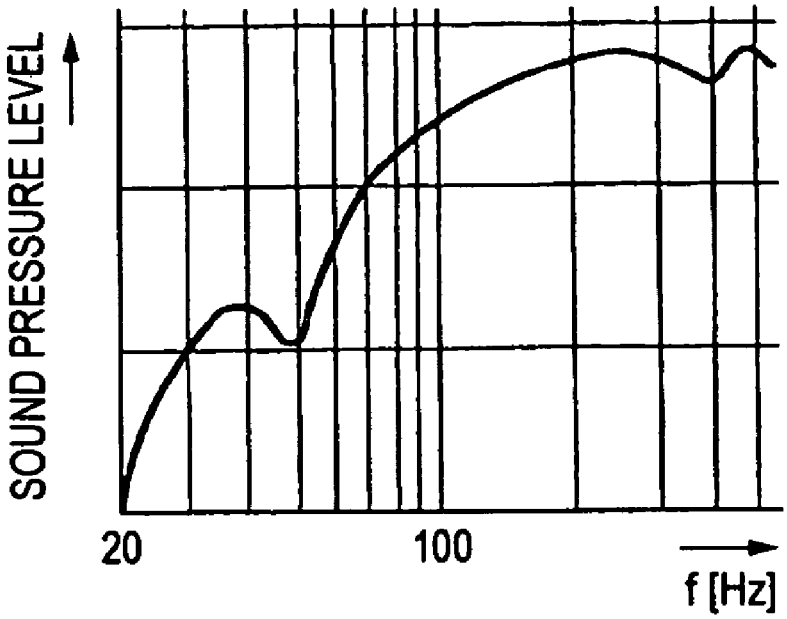
FIGS. 17A and 17B are views showing the frequency characteristic of a speaker 10 and a resonance frequency characteristic of a diaphragm 25 respectively.
Figure 17B:
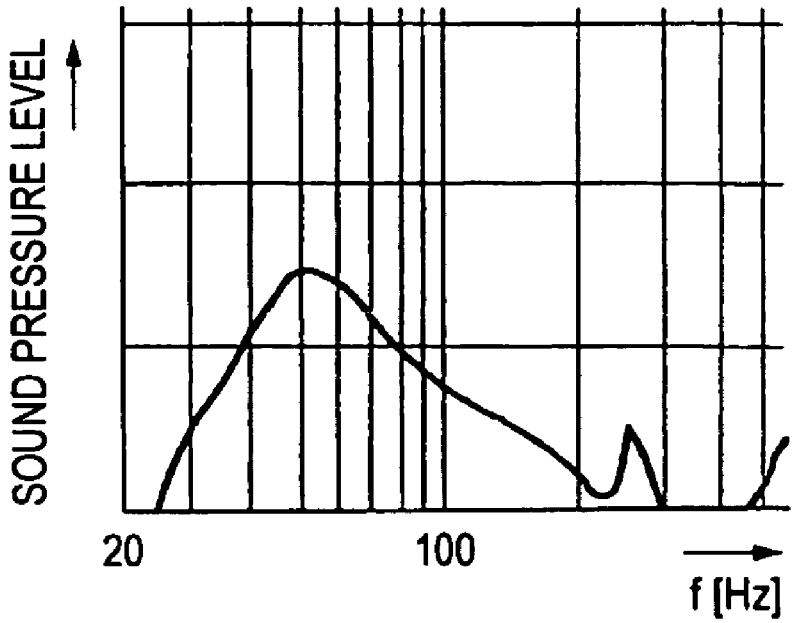

The resonance frequency decided as described above can be set to a desired value in which a low voice range is enhanced and a high voice range is cut off when the frequency characteristic of the speaker 10, a volume of the speaker enclosure 20, and a mass and an area of the diaphragm 25 are adjusted. FIG. 17(*a*) is a view showing the frequency characteristic of the speaker 10 and FIG. 17(*b*) shows an example of the resonance frequency characteristic of the diaphragm 25.

According to the present configuration, the low frequency range of the speaker system can be enhanced by using anyone of the above speaker driving apparatuses 30. In particular, preferably the above circuit configuration example 5 (FIG.7) or the circuit configuration example 6

(FIG.10) should be employed as the speaker driving apparatuses 30. In other words, in the above circuit configuration example 5 or the circuit configuration example 6, the low frequency signal is shaped into the monaural signal by adding the right and left stereo signals to separate the low frequency signal, and then the monaural low frequency signal is supplied to the right and left speakers 10. The right and left speakers 10 can vibrate in phase in the low frequency range by the low frequency signal. Then, this vibration is propagated to an air in the speaker enclosure 20, and then the diaphragm 25 is vibrated by this vibration of air. Accordingly, the low frequency range can be enhanced without loss of the energy.

Figure 18:
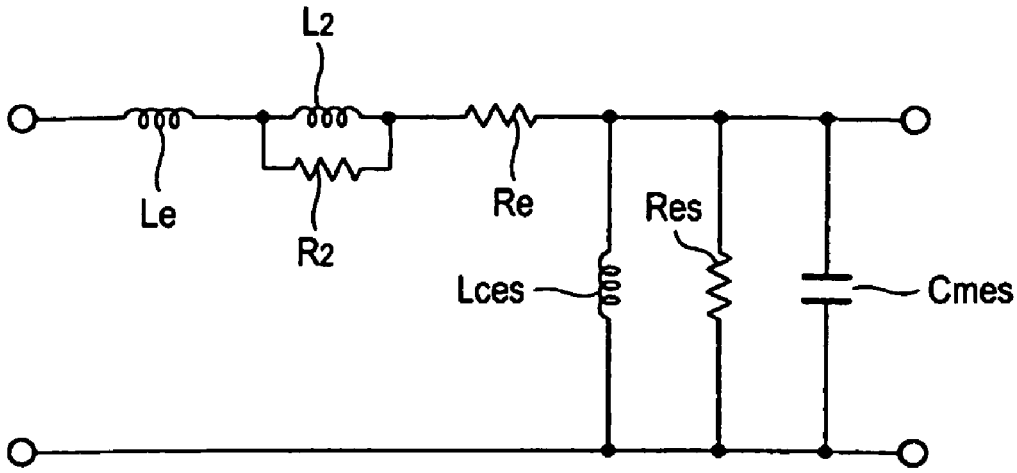
FIG. 18 is a diagram of an electric equivalent circuit of a speaker.

Here, differences between the invention of this case and the related art will be explained by using the equivalent circuit. FIG. 18 shows an electric equivalent circuit of a speaker. Such a configuration is provided that a low frequency resonance circuit (resonance frequency=F0) constructed by Cmes, Res, Lces is voltage-driven via a voice coil impedance.

Where Re=voice coil DC resistance

Le, L2, R2=high-frequency impedance rising element

Cmes=equivalent mass capacitance of the speaker vibration system

Lces=equivalent compliance inductance of the speaker vibration system

Res=mechanical braking resistance of the speaker vibration system

Figure 19:
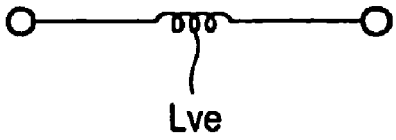
FIG. 19 is a diagram of an equivalent circuit of a speaker enclosure.

FIG.19 shows an equivalent circuit of a speaker enclosure, where Lve=equivalent volume inductance.

Figure 20:
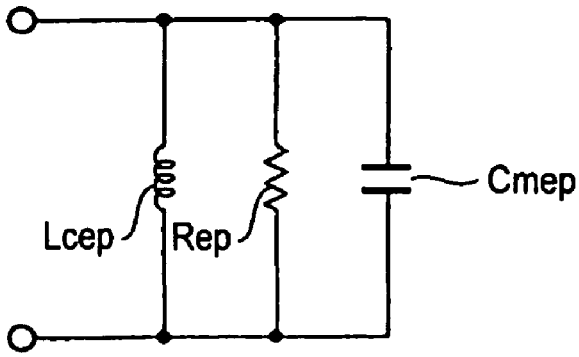
FIG. 20 is a diagram of an equivalent circuit of a passive radiator in the related art.

FIG.20 shows an equivalent circuit of a passive radiator such as a drawn cone, a hinge-joined flap, or the like in the related art. As shown in Figure, a circuit configuration obtained by eliminating factors of the voice coil 10 from the speaker is provided. A mass Cmep is supported by a compliance Lcep having an edge and a braking resistance Rep.

Where Cmep=equivalent mass capacitance of a passive radiator

Lcep=equivalent compliance inductance of the passive radiator

Rep=mechanical braking resistance of the passive radiator

15

Figure 21:
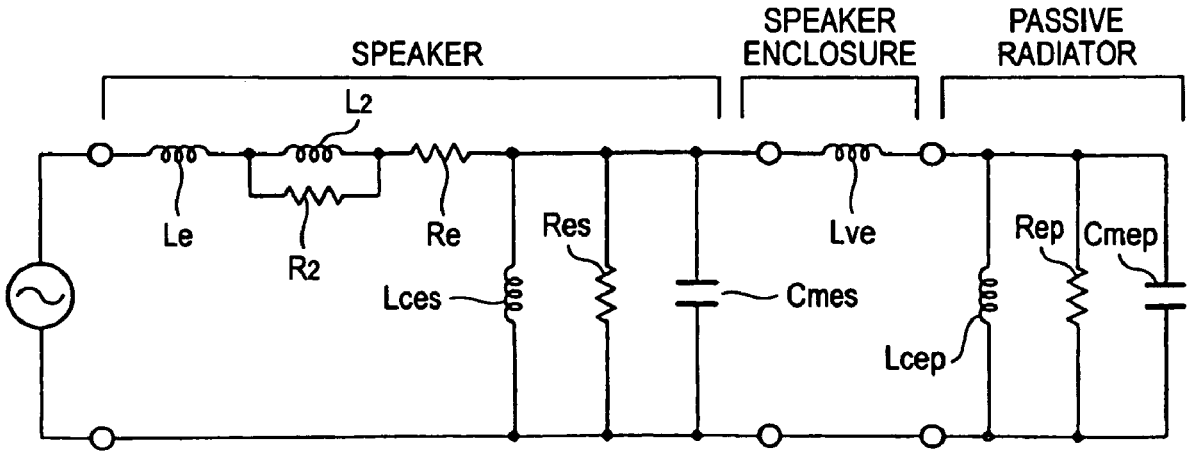
FIG. 21 is a diagram of an equivalent circuit of a passive radiator system in the related art.

FIG.21 shows an equivalent circuit of the passive radiator system in the related art. A signal voltage drives the speaker, and the acoustic output of the speaker drives the passive radiator via a speaker enclosure volume.

Where Cmep=equivalent mass capacitance of a passive radiator

Lcep=equivalent compliance inductance of the passive radiator

Rep=mechanical braking resistance of the passive radiator

FIG. 21 shows an equivalent circuit of the passive radiator system in the related art. A signal voltage drives the speaker, and the acoustic output of the speaker drives the passive radiator via a speaker enclosure volume.

A low-frequency resonance frequency as the system become almost equal to the resonance frequency given by Cmep and Lve. Then, Cmep must be increased to lower the resonance frequency by a small volume, which signifies that the passive radiator becomes heavy. In order to support the heavy passive radiator, a tough and strong edge is needed. In contrast, since a flexibility is required of the edge, a soft material such as rubber, urethane, or the like is employed. In this case, a thickness must be increased to enhance strength. However, the requirement that a thickness of the edge is increased yields that the equivalent compliance inductance Lcep should be decreased and simultaneously a braking force should be increased (the resistance value Rep should be lowered in the electric equivalent circuit). Therefore, a loss of the passive radiator is increased and then a capability of reproducing the low-pitched sound is lowered.

Figure 22:
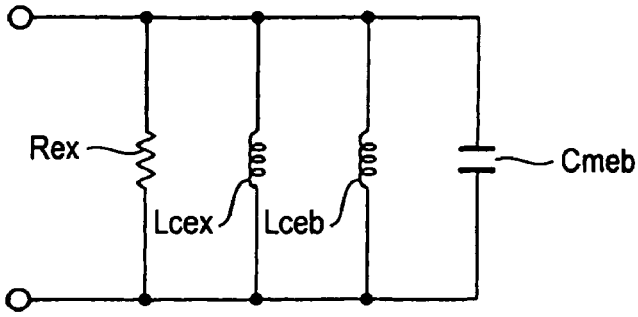
FIG. 22 is a diagram of an equivalent circuit of a diaphragm according to the present invention.

FIG.22 shows an equivalent circuit of the diaphragm 25 according to the present invention. Since one side of the diaphragm is fixed perfectly, the diaphragm itself has the compliance Lceb to support its own weight. Since the diaphragm is formed of an elastic member, a resistance component such as edge material can be ignored. Since the edge is not required to support its own weight of the diaphragm, such edge may be formed of a thin material and thus the compliance Lcex can be set very large. Accordingly, a loss can be reduced inevitably very small (The braking resistance Rex is increased in the electric equivalent circuit).

In FIG.22,

Cmeb=equivalent mass capacitance of the diaphragm

Lceb=equivalent compliance inductance of the diaphragm

Lcex=equivalent compliance inductance of the diaphragm edge

Rex=mechanical braking resistance of the diaphragm edge

Figure 23:
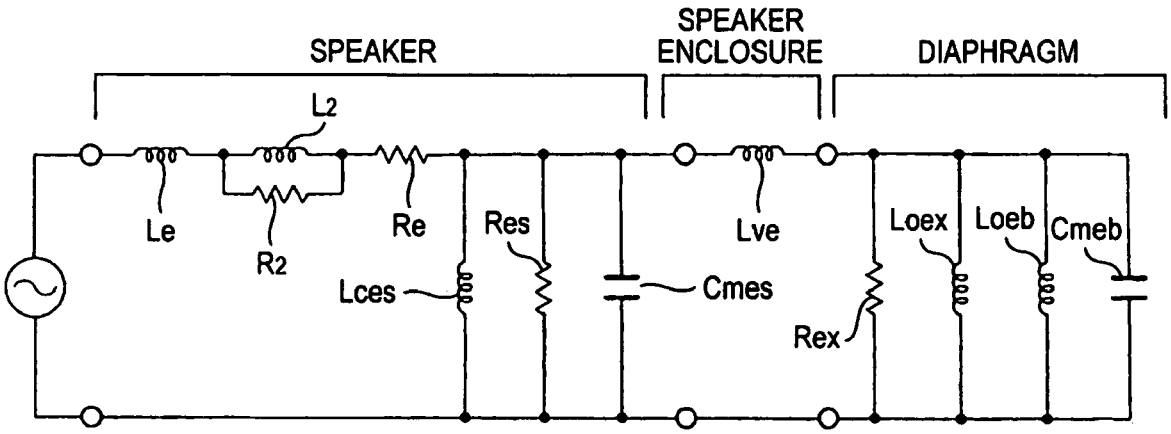
FIG. 23 is a diagram of an equivalent circuit of a speaker system according to the present invention.

FIG.23 shows an equivalent circuit of a speaker system according to the present invention. In comparison with FIG.21, their low frequency resonance frequencies become equal mutually if Cmep=Cmeb is satisfied under the assumption that the speaker and the speaker enclosure are the same. The equal compliances are needed as the compliance to support this weight. In this case, the compliance is given by Lcep in FIG.21 and the compliance is given by Lceb in FIG.23 because Lcex >>Lceb. As a result, the adequate design can give substantially Lcep=Lceb There is no great difference in the factors required until now between FIG.21 and FIG.23. However, as apparent from the explanation made up to now, a key feature of the invention of this application is that Rex>>Rep As a result, it is understood that a loss can be reduced largely rather than the conventional system and also the present embodiment is advantageous to the low-pitched sound reproduction.

Here, the diaphragm 25 can be fitted to any position of the speaker enclosure.

By the way, in the case where two speakers or more are fitted to the speaker enclosure that has a common rear space of the speakers therein and the stereo right and left signals are divided into two groups and supplied, when an opposite phase signal is contained in the stereo right and left signals, back pressures of the left-signal speaker and the right-signal speaker are canceled mutually in the inside of the speaker enclosure. In this cancellation state, not only the low-frequency range that is to be reproduced by the above diaphragm 25 (passive diaphragm) is not reproduced but also respective speakers are brought into a state that they are prone to very easily vibrate. In some cases the amplitude is too increased and then the reproduced sound is distorted when the amplitude exceeds a linearity of the reproducing characteristic of the speaker. In contrast, in the case of the usual music sound source (music source), in many cases the low-frequency signal is recorded in phase on the right and left channels at an almost equal sound volume. Also, even though a sound volume of the low-frequency signal gets distorted to any one of right and left channels intentionally, the above cancellation state does never become a problem when the common amplifier is used. However, the circuit such as the enhanced surround circuit, or the like to produce intentionally the opposite phase signal on the right and left channels is employed in the above speaker system, the cancellation state takes place and a problem arises in some cases. In particular, when the low range of the music sound source is deviated to any one of the right and left channels, the influence of the cancellation state appears notably. In such case, if the circuit such as the circuit shown in FIG. 10, or the like to shape the low-frequency signal into the monaural signal is added, or the circuit is constructed not to generate the opposite phase in the low-frequency range, for example, in the preceding stage of the circuit such as the enhanced surround circuit, or the like to produce the opposite phase signal on the right and left channels, occurrence of the cancellation state can be prevented.

[NEW]

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-306201 filed on Oct. 20, 2005, the contents of which are incorporated herein for reference.

What is claimed is:

1. A speaker driving apparatus, comprising:

a speaker enclosure whose inside is tightly closed;

at least two speakers that are provided to the speaker enclosure so as to have a common rear space; and a signal supplying unit that supplies a stereo left channel signal to the speaker in a first group and supplies a stereo right channel signal to the speaker in a second group, the at least two speakers being divided into two groups as the first group and the second group, wherein the signal supplying unit includes a low-frequency component monaural signal shaping unit which shapes a low frequency component into a monaural signal by extracting a low frequency component from the stereo right and left channel signals and then adding the low frequency component equally to right and left channels.

2. The speaker driving apparatus according to claim 1, wherein the signal supplying unit includes a surround effect applying unit which applies a surround effect to stereo signals; and wherein a stereo right channel signal and a stereo left channel signal to which the surround effect is applied by the surround effect applying unit are supplied to the speakers in the first group and the second group respectively.

3. The speaker driving apparatus according to claim 1, further comprising:

a diaphragm whose one end is fixed to one face of the speaker enclosure and whose elasticity allows to vibrate;

an opening structure that is provided to the one face in a position corresponding to a vibrating part of the diaphragm so as to expose an internal space of the speaker enclosure; and a sealing member that is provided between the diaphragm and the opening structure to close a space exposed by the opening structure in a state that a vibration of the diaphragm is allowed, and keeps an air tightness of the speaker enclosure, wherein the speakers are provided to any one face of the speaker enclosure.

4. The speaker driving apparatus according to claim 1, wherein the speaker in the first group and the speaker in the second group are arranged such that mutual sound radiating directions have a spread at a predetermined angle.

5. The speaker driving apparatus according to claim 4, wherein the speaker in the first group and the speaker in the second group are arranged such that a rear face of the speaker in the first group is opposed to a rear face of the speaker in the second group in the speaker enclosure.

6. A speaker driving apparatus according, comprising:

a speaker enclosure whose inside is tightly closed;

a diaphragm whose one end is fixed to one face of the speaker enclosure and whose elasticity allows to vibrate;

an opening structure that is provided to the one face in a position corresponding to a vibrating part of the diaphragm so as to expose an internal space of the speaker enclosure;

a sealing member that is provided between the diaphragm and the opening structure to close a space exposed by the opening structure in a state that a vibration of the diaphragm is allowed, and keeps an air tightness of the speaker enclosure, at least two speakers that are provided to the speaker enclosure so as to have a common rear space; and a signal supplying unit that supplies a stereo left channel signal to the speaker in a first group and supplies a stereo right channel signal to the speaker in a second group, the at least two speakers being divided into two groups as the first group and the second group, wherein the speakers are provided to any one face of the speaker enclosure.

7. The speaker driving apparatus according to claim 6, wherein the signal supplying unit includes a surround effect applying unit which applies a surround effect to stereo signals; and wherein a stereo right channel signal and a stereo left channel signal to which the surround effect is applied by the surround effect applying unit are supplied to the speakers in the first group and the second group respectively.

8. The speaker driving apparatus according to claim 6, wherein the signal supplying unit includes a low-frequency component monaural signal shaping unit which shapes a low frequency component into a monaural signal by extracting a low frequency component from the stereo right and left channel signals and then adding the low frequency component equally to right and left channels.

9. The speaker driving apparatus according to claim 6, wherein the speaker in the first group and the speaker in the second group are arranged such that mutual sound radiating directions have a spread at a predetermined angle.

10. The speaker driving apparatus according to claim 9, wherein the speaker in the first group and the speaker in the second group are arranged such that a rear face of the speaker in the first group is opposed to a rear face of the speaker in the second group in the speaker enclosure.

11. The speaker driving apparatus according to claim 6, further comprising:

a circuit for not generating opposite phases in the stereo left channel signal and the stereo right channel signal in a low-frequency range.

* * * * *